US009284942B2

(12) United States Patent
Allart et al.

(10) Patent No.: US 9,284,942 B2
(45) Date of Patent: Mar. 15, 2016

(54) SUBASSEMBLY FORMING A HYDROBASE FOR HYDRAULIC MOTORS, AND ASSEMBLY METHOD

(75) Inventors: Bernard Allart, Crepy en Valois (FR); Cécile Borgnon, Thourotte (FR); Gery Depierre, La Croix Saint-Ouen (FR); Hervé Desumeur, Le Meux (FR); Philippe Lucienne, Aumont en Halatte (FR); Clément Recoura, Damery (FR); Julien Viard, Pontpoint (FR)

(73) Assignee: Poclain Hydraulics Industrie (FR)

( * ) Notice: Subject to any disclaimer, the term of this patent is extended or adjusted under 35 U.S.C. 154(b) by 838 days.

(21) Appl. No.: 13/576,311

(22) PCT Filed: Jan. 28, 2011

(86) PCT No.: PCT/EP2011/051262

§ 371 (c)(1),
(2), (4) Date: Jul. 31, 2012

(87) PCT Pub. No.: WO2011/092312

PCT Pub. Date: Aug. 4, 2011

(65) Prior Publication Data

US 2012/0297972 A1 Nov. 29, 2012

(30) Foreign Application Priority Data

Feb. 1, 2010 (FR) ..... 10 50667

(51) Int. Cl.
*F03C 1/047* (2006.01)
*F03C 1/30* (2006.01)
(Continued)

(52) U.S. Cl.
CPC ..... *F03C 1/0472* (2013.01); *F03C 1/0409* (2013.01); *F03C 1/0428* (2013.01);
(Continued)

(58) Field of Classification Search
CPC ..... F03C 1/047; F04B 1/047; F04B 1/1071; F04B 39/14
See application file for complete search history.

(56) References Cited

U.S. PATENT DOCUMENTS

| | | | | |
|---|---|---|---|---|
| 4,326,450 | A * | 4/1982 | Bacquie | 91/487 |
| 4,522,110 | A | 6/1985 | Samuelsson | |
| 6,036,611 | A * | 3/2000 | Bigo et al. | 474/88 |

FOREIGN PATENT DOCUMENTS

| | | | |
|---|---|---|---|
| DE | 102008017535 | B3 | 8/2009 |
| FR | 2651836 | A1 | 3/1991 |

(Continued)

OTHER PUBLICATIONS

International Search Report for Application No. PCT/EP2011/051262 dated Mar. 4, 2011.

*Primary Examiner* — F. Daniel Lopez
(74) *Attorney, Agent, or Firm* — Lerner, David, Littenberg, Krumholz & Mentlik, LLP

(57) ABSTRACT

The present invention relates to a subassembly for forming a hydraulic motor after assembly onto an assembly including a shaft, said subassembly including a cover forming a housing element, a multilobe cam, a cylinder block opposite the cam, pistons guided so as to slide radially within the respective cylinders of the cylinder block and bearing on the lobes of the cam, and a valve intended to apply pressurized fluid to said pistons in series, wherein said subassembly includes means for temporarily attaching the cylinder block to the cover and means for accessing an element of the valve through the cover in order to enable, during installation, the angular positioning of said element with respect to the shaft, followed by the attachment thereof to the shaft. The present invention also relates to a method for assembling such a hydrobase.

20 Claims, 14 Drawing Sheets

(51) Int. Cl.

| | |
|---|---|
| ***F03C 1/04*** | (2006.01) |
| ***F04B 1/04*** | (2006.01) |
| ***F04B 1/047*** | (2006.01) |

(52) U.S. Cl.

CPC ..... *F03C1/0476* (2013.01); *F04B 1/0413* (2013.01); *F04B 1/0472* (2013.01); *F04B 1/0476* (2013.01); *Y10T 29/49236* (2015.01)

(56) References Cited

FOREIGN PATENT DOCUMENTS

| | | |
|---|---|---|
| FR | 2834012 A1 | 6/2003 |
| WO | 0236964 A1 | 5/2002 |

* cited by examiner

State of the art

State
of the art

State
of the art

SUBASSEMBLY FORMING A HYDROBASE FOR HYDRAULIC MOTORS, AND ASSEMBLY METHOD

CROSS REFERENCE TO RELATED APPLICATIONS

The present application is a national phase entry under 35 U.S.C. §371 of International Application No. PCT/EP2011/051262, filed Jan. 28, 2011, published in French, which claims priority from French Patent Application No. 1050667, filed Feb. 1, 2010, the disclosures of which are incorporated by reference herein.

The present invention relates to the field of hydraulic motors.

More precisely, the present invention relates to the field of hydraulic motors with radial pistons.

The applicant has already proposed numerous models of such hydraulic motors with radial pistons.

Figure 1:
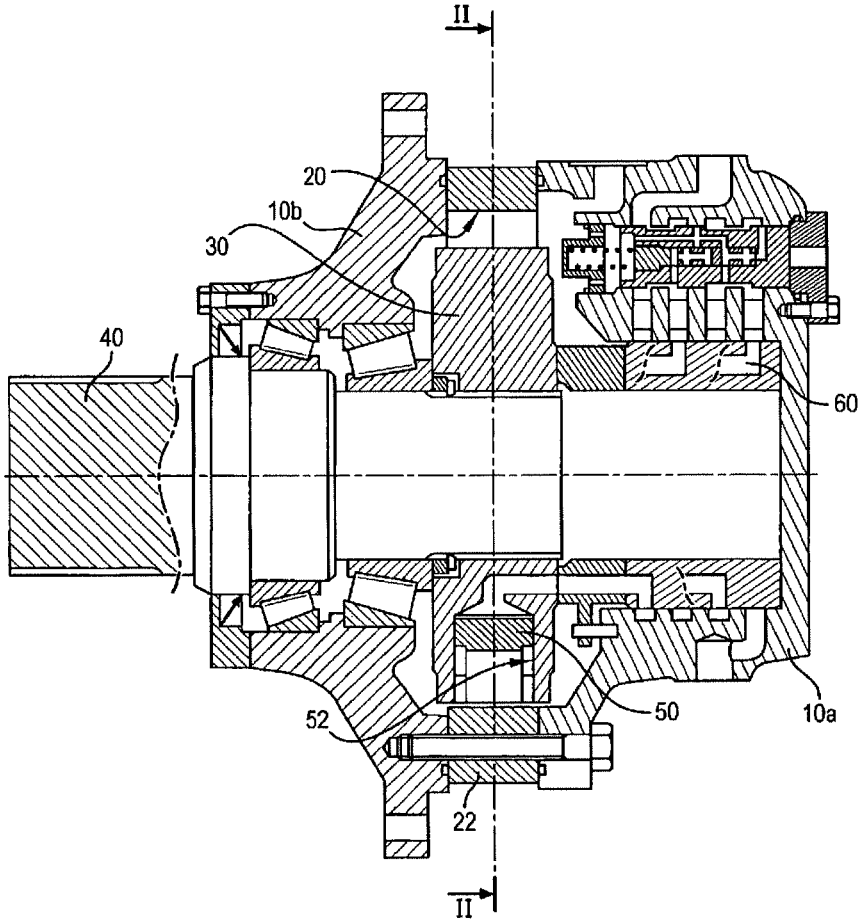
Figure 2:
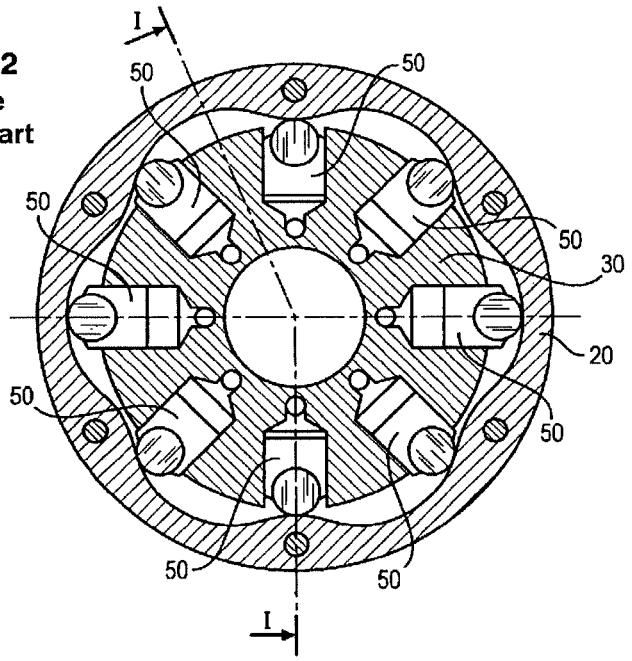

As shown in longitudinal section in FIG. 1 and in transversal section in FIG. 2, hydraulic motors with radial pistons of the above type generally comprise in a casing 10 comprising two semi-casings 10*a* and 10*b* and a cam 20:

- said multilobe cam 20, preferably formed on the internal surface of an element 22 of the casing 10,
- a cylinder block 30 mounted to rotate relatively in the casing 10,
- a shaft 40 attached rotatively to the cylinder block 30,
- pistons 50 guided to slide radially in respective cylinders 52 of the cylinder block and being supported on the lobes of the cam 20, and
- a distributor 60 adapted to successively apply controlled pressurised fluid on the pistons 50 such that successive support of the pistons 50 on the lobes of the cam 20 causes relative rotation of the cylinder block 30 and of the elements attached thereto relative to the casing 10.

To build a hydraulic motor, all of the pieces are assembled definitively: the cam 20 is fixed by bolting between the two casings 10*a* and 10*b*, and the shaft 40, borne by the casing 10*b*, itself bears the cylinder block 30.

In addition, the pistons are hooked in the cylinders and are held in their housing when the cylinder block is inserted in the cam. Finally, the distributor 60 is held in place in the casing 10*a* by angular positioning means.

Figures 3A, 3B:
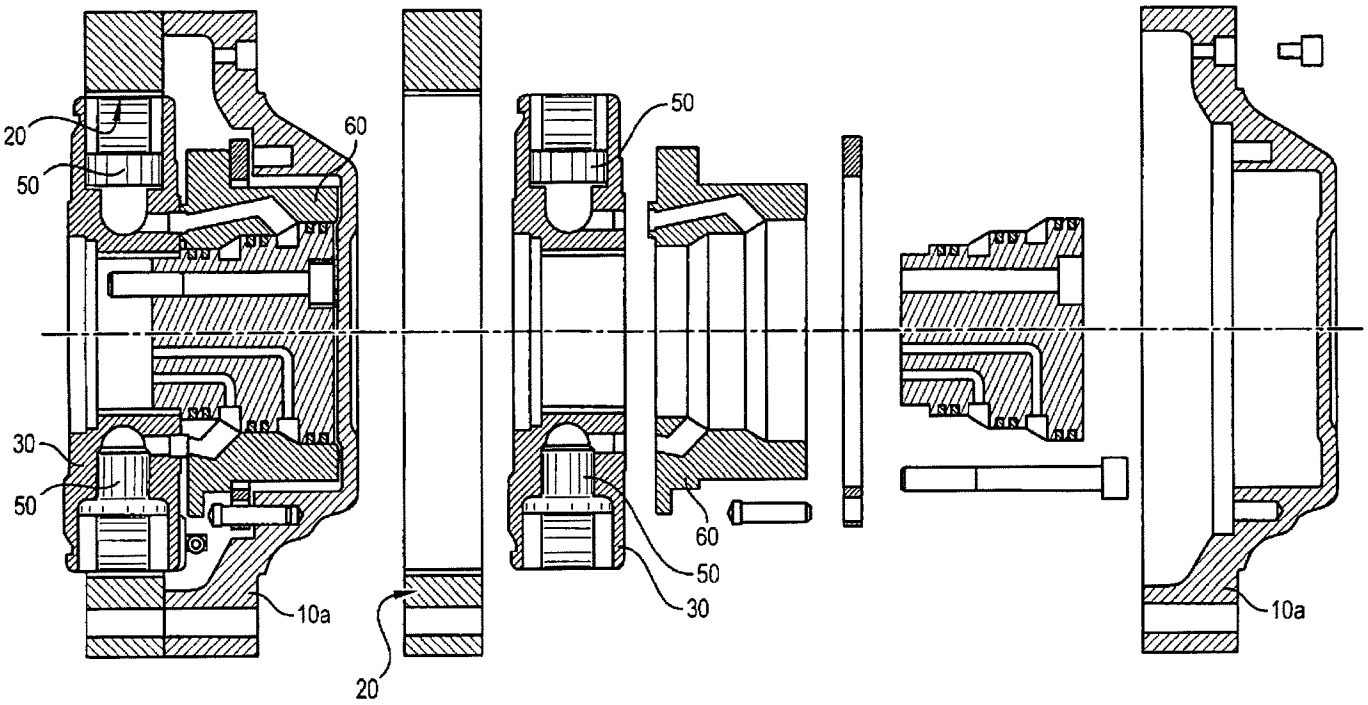

But in numerous cases, the aim is to provide not such a complete motor equipped with its shaft 40, but only a subassembly such as shown in FIG. 3*a*, comprising the basic elements of the motor, specifically cam 20, cylinder block 30, pistons 50 and distributor 60, in a housing 10*a*, also called a cover which constitutes a semi-casing for the final motor. Such a subassembly constituting an incomplete motor is intended to be inserted in the kinematic chain of a user by fitting on a shaft and/or on a complementary casing element 10*b* able to contain a bearing. More generally, this subassembly comprises rotary elements and fixed elements (for example respectively a cylinder block and a distributor on one hand, and a cam on the other hand). To constitute a complete motor, these elements are then assembled respectively on rotary elements and complementary fixed elements (for example respectively a shaft on one hand and a casing element comprising a bearing on the other hand).

Such an ensemble is generally called a hydrobase by the applicant. However, prior to fixing of the hydrobase to a shaft and a semi-casing able or not to contain a bearing, the latter cannot be held in the mounted state such as illustrated in FIG. 3*a*. In reality, it is in the form of a collection of unconnected pieces, as in FIG. 3*b*. For example, the cam 20 is not attached to the cover 10*a*, and the cylinder block 30 is not held in place.

Despite strong demand for such subassemblies, means currently available on the market do not always provide total satisfaction.

Therefore one difficulty in using such a hydrobase, delivered in the form of a collection of unassembled pieces, is the risk of loss, deterioration or mix-up of these pieces, as well as their pollution or their poor assembly by their user.

A main aim of the present invention is to refine the known means of the state of the art so as to particularly make fitting of such subassemblies on a shaft or bearing easier.

Another aim of the invention is to propose a hydrobase in the assembled and sealed form, prior to its assembly on a subassembly comprising a shaft and a casing able to contain a bearing, allowing it to be transported without either deterioration or pollution, and with pre-positioned elements according to the arrangement selected by the manufacturer.

The present invention applies in particular to the case of implanting a motor having a shaft fixed relative to the frame of the machine and a rotary casing, for example connected to a wheel.

The person skilled in the art knows that particularly in this case the above aim is difficult to achieve, on one hand due to the weight of hydrobases and, on the other hand due to the fact that most frequently such hydrobases require blind assembly on the shaft or bearing support of the machine to be fitted.

The above aim is achieved within the scope of the present invention due to a subassembly or hydrobase intended to form a hydraulic motor after assembly on an assembly comprising a shaft, which subassembly comprises a cover forming a casing element, a multilobe cam, a cylinder block placed opposite the cam, pistons guided to slide radially in respective cylinders of the cylinder block and being supported on the lobes of the cam and a distributor intended to successively apply pressurised fluid on said pistons, characterised in that it comprises provisional fixation means of the cylinder block on the cover and access means to an element of the distributor, through the cover, to enable the angular orientation of this element relative to the shaft during assembly, then its fixing on the shaft.

According to another advantageous characteristic of the invention, the subassembly or hydrobase comprises means ensuring angular pre-positioning and/or fixing of the cam on the cover, for example by means of pins or screws.

The present invention also relates to an assembly process of the subassembly or hydrobase according to the present invention to form a hydraulic motor.

Figure 4:
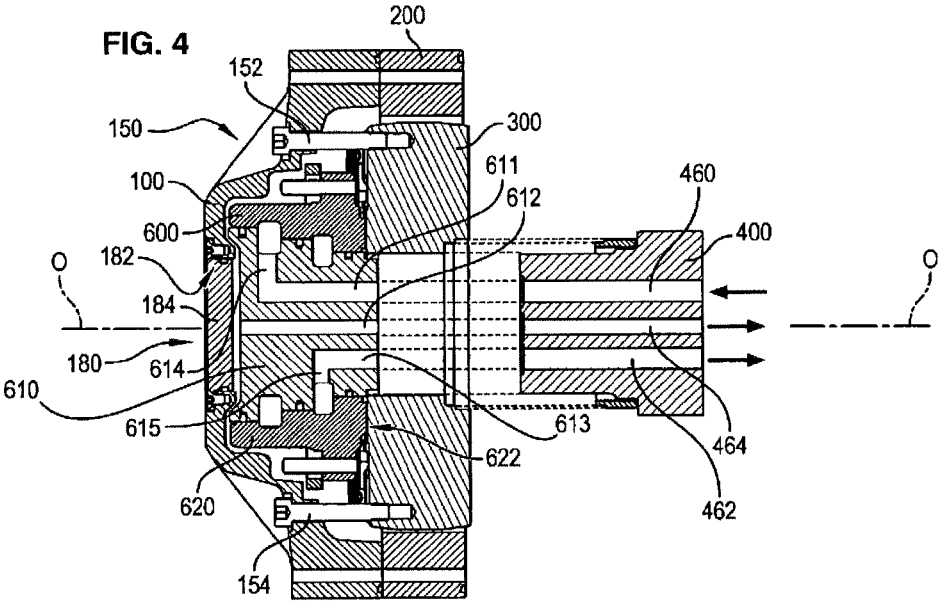
Figure 5:
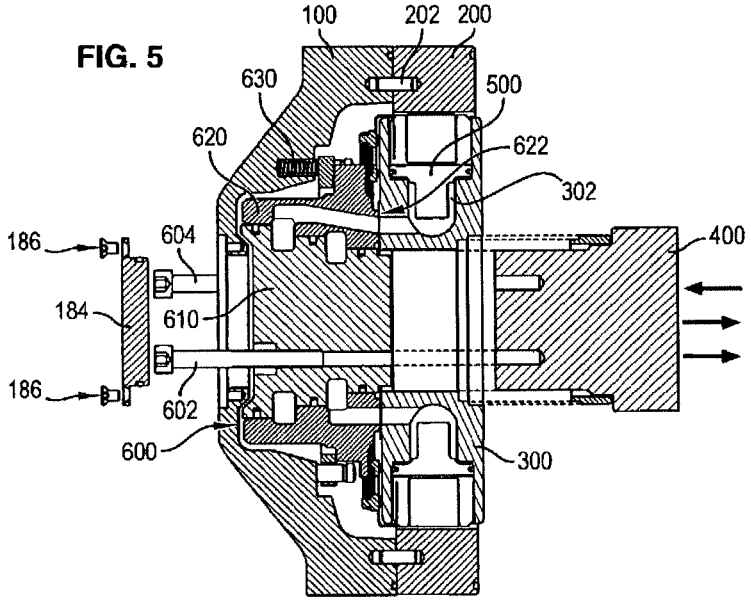
Figure 6:
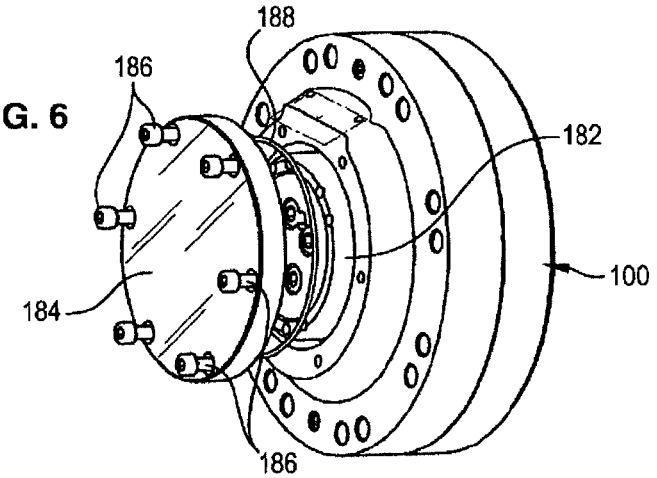
Figure 7:
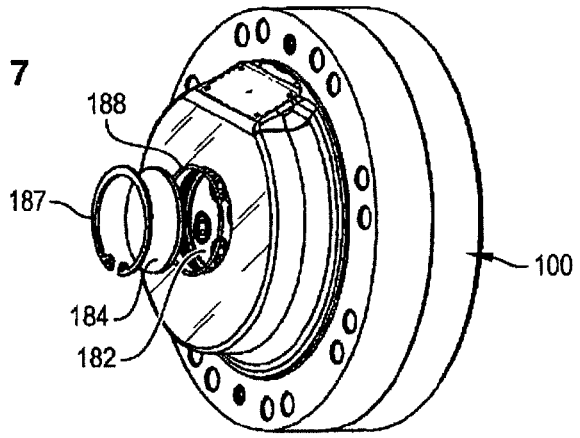
Figure 8:
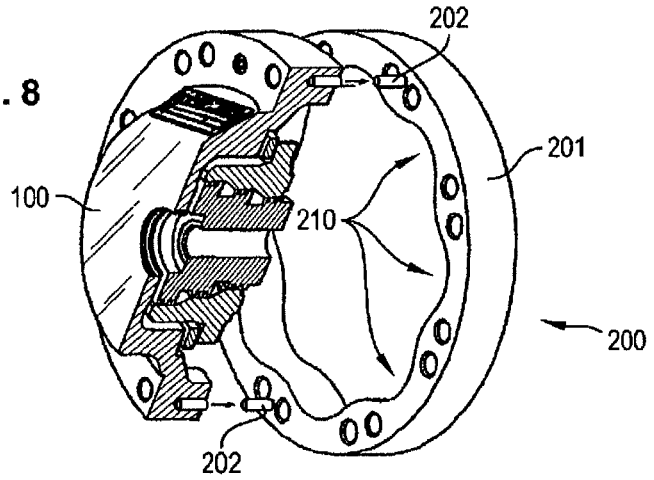
Figure 9:
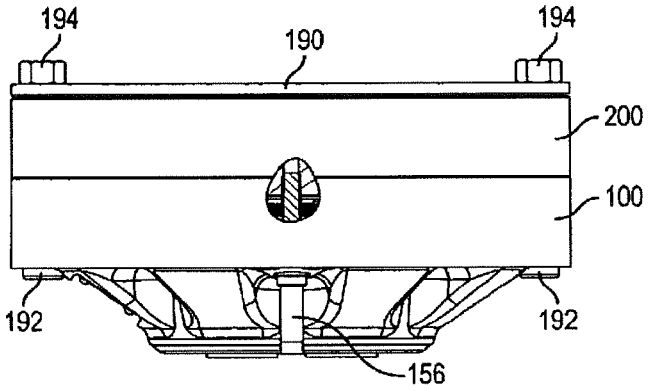
Figure 10:
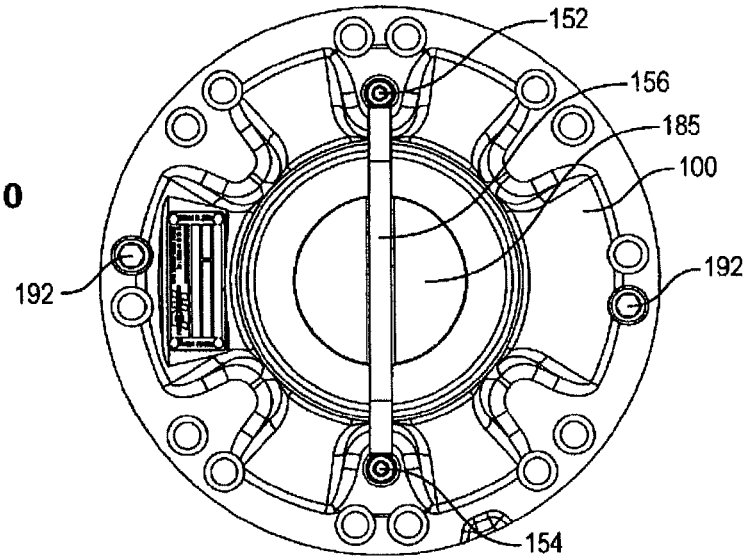

Other characteristics, aims and advantages of the present invention will emerge from the following detailed description, and relative to the attached diagrams given by way of non-limiting examples and in which:

FIG. 1 previously described illustrates a view in longitudinal section of a hydraulic motor known from the state of the art according to the section planes referenced I-I in FIG. 2, FIG. 2 illustrates a view in transversal section of the same hydraulic motor according to the section plane referenced II-II in FIG. 1, FIG. 3*a* previously described is a representational view in longitudinal section of the arrangement of the pieces of a hydrobase known from the state of the art in the assembled form, and prior to assembly on a subassembly comprising a shaft and a casing element, FIG. 3*b* illustrates a view of the collection of pieces constituting a hydrobase prior to their assembly, FIG. 4 illustrates a view in longitudinal section of axis O-O of a hydrobase in keeping with an embodiment of the present invention, and illustrating in particular provisional fixing means of the cylinder blocks on the cover, FIG. 5 illustrates a view in longitudinal section of a hydrobase in keeping with an embodiment of the present invention, according to a section plane different to that of FIG. 4, and illustrates in particular the definitive fixing of a piece of the distributor on a shaft, FIGS. 6 and 7 illustrate perspective views of two embodiments of a hydrobase according to the present invention and more precisely illustrate two particular embodiments of the access means through the cover on an element of the distributor to allow angular orientation of this element during assembly, FIG. 8 illustrates a partial view in exploded perspective of a hydrobase according to the present invention and more precisely illustrates angular indexing means between the cam and the cover of a hydrobase according to the present invention, FIGS. 9 and 10 illustrate two lateral external views, respectively transversal and axial, of just a hydrobase according to the present invention, assembled by its provisional fixing means and closed by a closing plate, and FIGS. 11 to 26 illustrate successive views illustrating an assembly process of a hydrobase according to the present invention on an assembly comprising a shaft and a casing element of a machine to be fitted.

As specified earlier, the subassembly or hydrobase according to the present invention essentially comprises a casing element forming a cover 100, a cam 200, a cylinder block 300 and a distributor 600.

Each of these elements cover 100, cam 200, cylinder block 300 and distributor 600 can form the subject of numerous embodiments known per se to the person skilled in the art, corresponding to conventional hydraulic motors and conventional hydrobases, motors with radial pistons and multilobe cams, also called high-torque and low-speed motors.

Because of this, the precise structure of these elements of cover 100, cam 200, cylinder block 300 and distributor 600 will not be described in detail herein below.

It is evident however that the hydrobase according to the present invention is centred on an axis of rotation O-O.

The cover 100 constitutes a sealed wall transversal to the axis O-O which covers a complete lateral side of the hydrobase. Its contour is preferably circular.

The cam 200 is formed preferably by a ring 201 adjacent to the axially internal face of the cover 100 at the level of the outermost radially peripheral zone of the cover 100.

As it can be seen for example in FIG. 8, on its radially internal surface the cam 200 has a series of regular lobes 210 uniformly distributed around the axis O-O. Each of the lobes 210 has overall an appearance of sinusoidal type.

The cam 200 is attached to the cover 100. It is also fixed to the rotary hub of the wheel of the machine which bears the rim.

The cylinder block 300 is placed inside the ring 201 constituting the cam 200. It defines a plurality of cylinders 302 oriented radially relative to the axis O-O and terminating on the peripheral external face of the cylinder block 300 opposite the cam 200. A piston 500 is mounted to slide respectively radially in each of the cylinders 302. It is supported on the radially internal surface of the cam 200.

The cylinder block 300 has a central bore by which the cylinder block 300 is engaged on the end of the shaft of the machine to be fitted. Also, this bore has a series of longitudinal flutes complementary to flutes 402 provided on the end of the shaft to ensure angular indexing of the cylinder block 300 on the shaft, once the hydrobase is installed.

The distributor 600 is designed to apply controlled pressurised fluid successively on each of the pistons 500, more precisely in the radially internal chamber of the cylinders 302 adjacent to the pistons such that the successive pressure of the pistons 500 on the lobes of the cam 200 causes relative rotation of the cylinder block 300 and of the elements which are attached thereto relative to the cover 100, during use on an equipped machine.

For this purpose, there is a dissymmetry between the number of lobes 210 formed on the cam 200 and the number of associated pistons 500 located in the cylinder block 300.

In a non-limiting manner, according to the illustration in FIG. 2 which can be viewed in this respect in the hydrobase according to the invention, there are six hollow lobes 210 provided on the cam 200 and eight associated pistons 500.

As illustrated in FIGS. 4 and 5, the distributor 600 is formed from two pieces: a central piece 610 or "ice shield" intended to be placed opposite the end of the shaft and be fixed to the latter, and an external piece 620 or "ice" placed around the central piece 610, attached to rotate with the cover 100 by any appropriate means, for example a finger or a wedge pin for longitudinal sliding between the external piece 620 and the cover 100.

By way of variant the indexing means provided between the cover 100 and the piece 620 can be formed by a mechanism such as an Oldham joint, ensuring play-free transmission of rotation movement between the cover 100 and the piece 620 by keeping their axes parallel but not necessarily concentric. Such a mechanism can be formed from a washer perpendicular to the axes of rotation comprising oblong radial holes which respectively receive pieces solid with the cover 100 and pieces solid with the external piece 620. This means allows limited sliding in directions perpendicular to the axis of the motor, while ensuring precise angular setting.

The external piece 620 has a transversal face 622 connected to a face complementary to the cylinder block. The central piece 610 has a series of channels having longitudinal sections 611, 612, 613 which terminate in respectively complementary 460, 462, 464 channels formed in the shaft 400 to ensure the supply and drain functions and transverse sections 614, 615 which terminate on the radially external face of this central piece 610 at the level of peripheral annular throats, opposite the external piece 620. The latter has as such channels which have transverse sections terminating opposite the annular throats attached to the transverse sections 614, 615 of the central piece 610 and longitudinal sections terminating opposite the supply orifices formed in the piston chambers of the cylinder block 300.

In FIG. 4, the channel 460 illustrates a supply channel of the distributor 600, the channel 462 illustrates a channel conveying the fluid returning from the distributor and the channel 464 illustrates a drain channel which ensures the return of leaks.

Since the general operation of such a hydrobase is known to the person skilled in the art, it will not be described in further detail herein below.

When in use, the cylinder block 300 is attached to rotate with the shaft of the machine to be fitted and it is fixed in rotation relative to the central piece of the distributor 600. The shaft naturally does not form part of the hydrobase, and has been shown in FIGS. 4 and 5 only for better understanding of the hydraulic interface between the hydrobase and the rest of the machine. Feeding of the pressure chambers by the pistons with fluid flowing through channels formed in the shaft and the distributor ensures rotation of the cam 200 relative to the cylinder block 300 and of the cover 100, of the external distributor piece 620 and all the elements which are attached thereto.

The respective surface areas of the exposed cross-sections on either side of channels formed in the external piece 620 of the distributor 600 preferably differ in each channel as well as among the different channels. When distributor 600 is pressurized with a fluid, this configuration generates a force that pushes the external piece 620 axially against the adjacent face of cylinder block 300 to ensure relative tightness and to prevent fluid leakage between distributor 600 and cylinder block 300.

When required, the pressure from the ice or external piece 620 against the face opposite the cylinder block 300 can be reinforced by springs 630. Such an arrangement improves the operation of the motor in the very first moments after application of hydraulic pressure.

The tightness at the level of communication between the channels of the two pieces, central 610 and external 620, of the distributor is ensured by joints or any equivalent means, for example segments made of cast iron or plastic.

According to an essential characteristic of the invention, as indicated previously, the hydrobase comprises means 150, such as provisional fasteners, for provisional fixing of the cylinder block 300 on the cover 100, as well as access means 180, through the cover 100, to an element of the distributor 600 to enable angular orientation of this element during assembly relative to the shaft which receives the hydrobase.

Even more precisely, according to the particular non-limiting embodiment illustrated in FIG. 4, such provisional fasteners or means for provisional fixing of the cylinder block 300 on the cover 100 are formed for example by two screws or bolts 152, 154 engaged in diametrically opposite boreholes formed in the cover 100 opposite two respectively associated boreholes formed in the cylinder block 300.

The person skilled in the art will easily understand from the attached FIG. 4 that these fixing means 152, 154 help to angularly preposition and hold the cylinder block 300 firmly relative to the distributor 600 and to the cover 100, prior to use.

Of course, as will be explained later, such fixing means 152, 154 must be withdrawn prior to use of the hydrobase in a motor.

The means 180 allowing access to the distributor 600 through the cover 100 can be formed from different embodiments. They are preferably formed by an opening 182 formed in the centre of the cover 100 and passing through the latter, associated with a damper 184 fixed on the cover 100 by any appropriate removable means.

According to FIG. 6, the fixing means of the damper 184 are formed by a plurality of screws 186 uniformly distributed in boreholes formed in the damper 184 and cooperating with complementary threaded bores formed on the cover 100.

According to FIG. 7, the damper 184 is fixed by means of an elastic ring 187 of Circlips™ type or any equivalent means.

The presence of a sealing joint 188 between the damper 184 and the face opposite the cover 100 is to be noted.

As illustrated in FIG. 8, preferably within the scope of the invention means for pre-positioning and/or fixing the cam 200 on the cover 100 are also provided, for example in the form of pins 202 or screws oriented parallel to the axis O-O and interacting at the same time with the cam 200 and the cover 100.

The presence of access means to the distributor 600 through the cover 100 angularly orients the distributor 600 to align the latter correctly relative to supply and/or drain channels coming from the shaft.

The hydrobase according to the present invention is preferably also delivered with plugs for blocking all the boreholes made in the cover 100, in particular those for receiving fixing means 152, 154. The above boreholes can serve optionally as drain orifices within the scope of later maintenance.

It is also visible on FIG. 9 that the hydrobase is preferably closed, prior to its assembly on the assigned shaft, by a plate 190 located on the face of the cam 200 opposite the cover 100. This plate 190 is fixed by means of any appropriate means, for example by means of a plurality of complementary bolts 192 and nuts 194.

Such a plate 190 can also form the subject of numerous embodiments and is preferably a simple flat disc of the same external diameter as the cam 200.

The assembly process of a hydrobase according to the present invention on an associated assembly of a machine, comprising a shaft and a casing element which may comprise a bearing will now be described.

Prior to its assembly on the receiving machine, the hydrobase is as shown in FIGS. 9 and 10 in the form of a block pre-assembled by provisional fixing means. This block comprises all the elements mentioned above, which are already positioned relative to one another in their final operation mode on the receiving machine, with the exception of the angular adjustment of the distributor relative to the receiving shaft.

In this context, the cover 100 of the hydrobase is intended for example to be made solid with the mobile rim of a wheel, the above complementary shaft being as such fixed relative to the frame of a machine.

Figure 11:
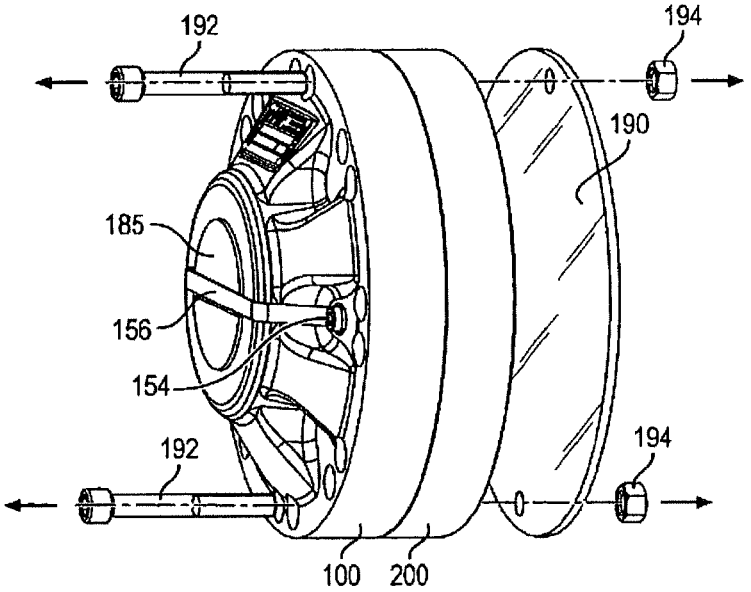

In the first instance, as illustrated in FIG. 11, the closing plate 190 should be withdrawn by pulling out the fixing means 192, 194.

Figure 13:
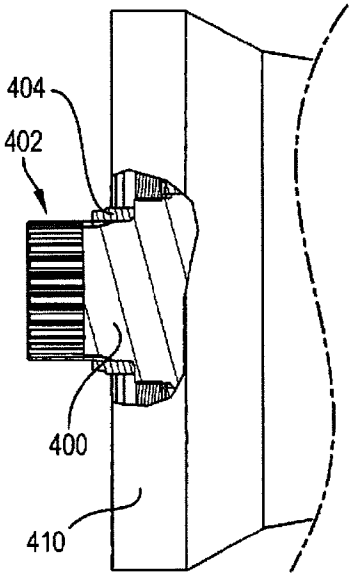
Figure 12:
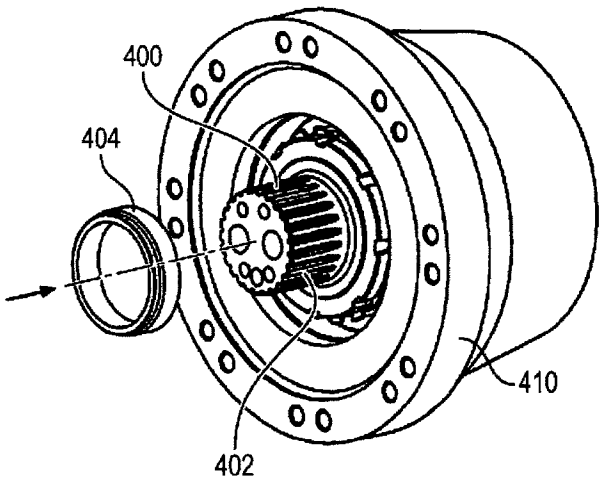
Figure 15:
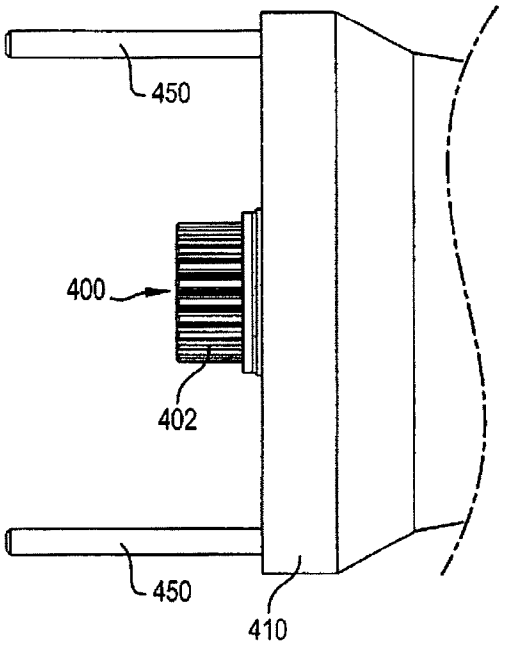
Figure 14:
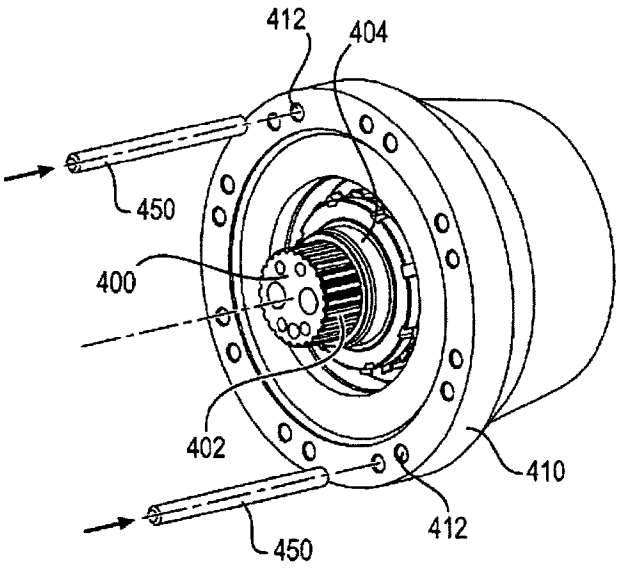

At the same time, as illustrated in FIGS. 12 and 13, the frame 410 of the machine and more precisely the output shaft 400 which preferably comprises longitudinal flutes 402, can be equipped with any appropriate accessory, for example a ring 404 forming a bearing.

To make positioning of the hydrobase opposite the frame easier, the latter is preferably fitted with support rods 450 parallel to the axis O-O engaged for example in complementary bores 412 formed in the frame 410 with a distance corresponding to complementary boreholes formed in the hydrobase, more precisely through the cam 200 and the external periphery of the cover 100.

Figure 17:
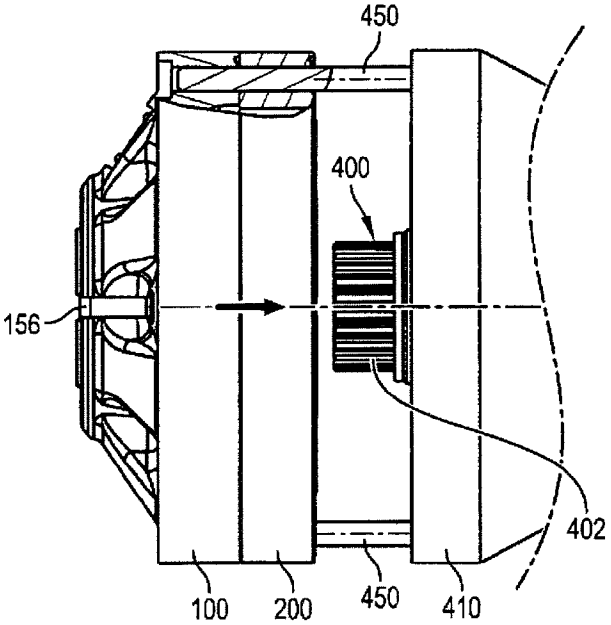
Figure 16:
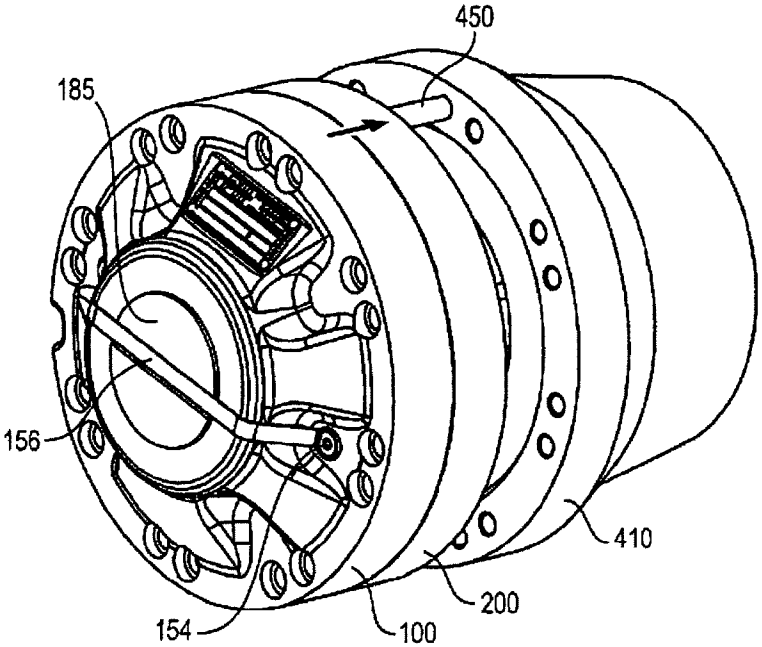

So, as illustrated in FIGS. 16 and 17, the hydrobase deprived of its closing plate 190 can be engaged on the rods 450 to make handling easier by carrying the weight of the hydrobase forward partly onto the rods 450. The use of such rods 450 also makes centering of the hydrobase on the axis of the shaft 400 easier.

Figure 18:
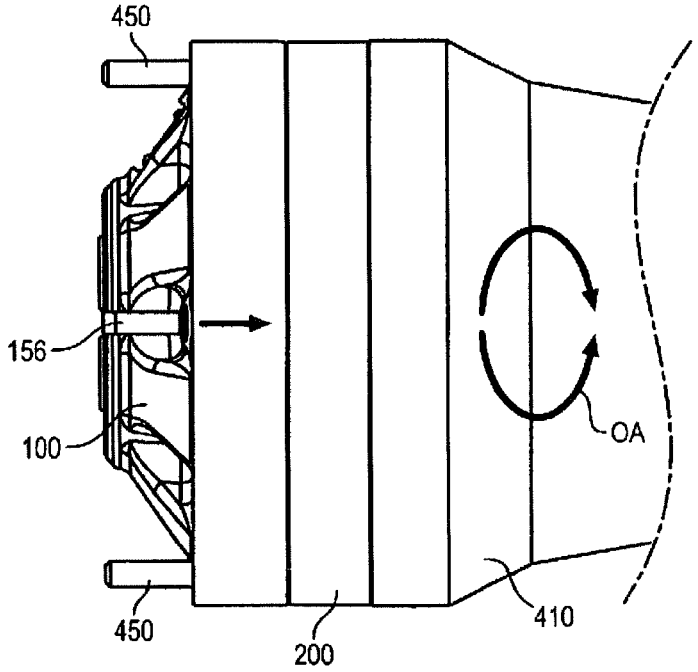

The hydrobase is then pushed to slide axially to move more closely to the fluted shaft 400. As shown in FIG. 18 by the arrows OA in the theory where the flutes 402 of the shaft 400 are not aligned with the complementary flutes provided on the internal periphery of the cylinder block 300, the installer proceeds with angular orientation relative to the hydrobase and to the shaft 400 to engage the cylinder block 300 on said flutes 402 of the shaft 400.

Figure 20:
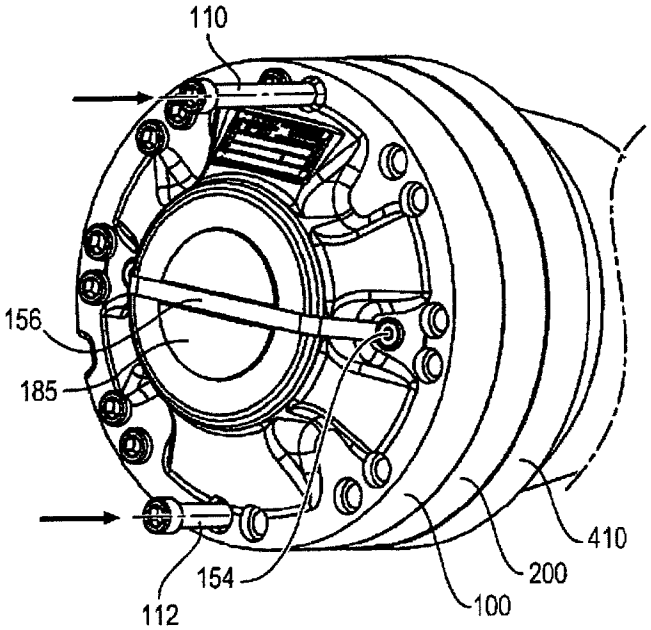
Figure 19:
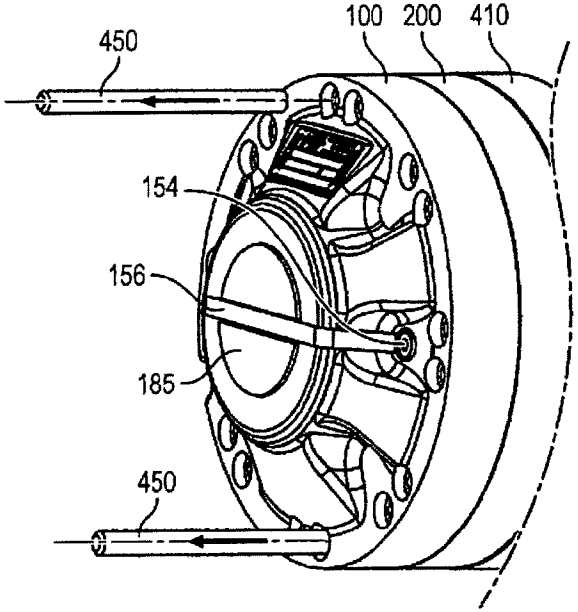

The provisional support rods 450 can then be pulled out as illustrated in FIG. 19 and replaced by bolts or fixing screws 110, 112, as shown in FIG. 20.

The fixing means of the cylinder block 300 should then be withdrawn by loosening the screws 152, 154.

Figure 22:
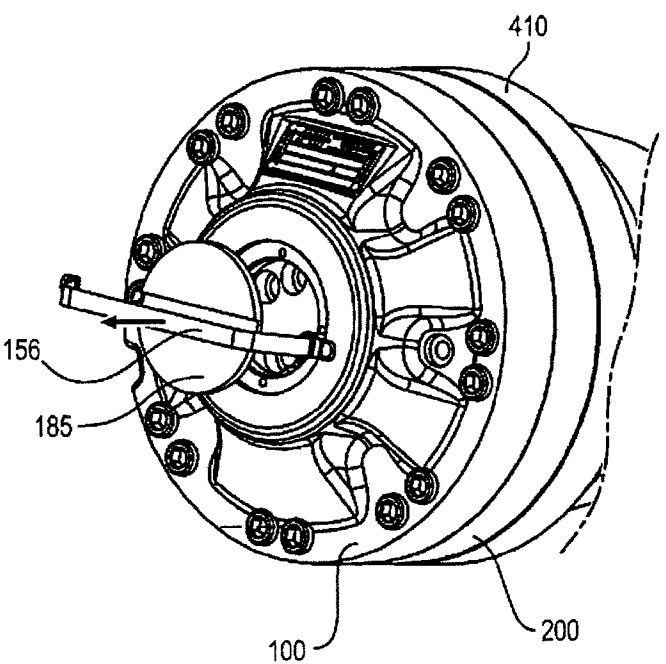
Figure 21:
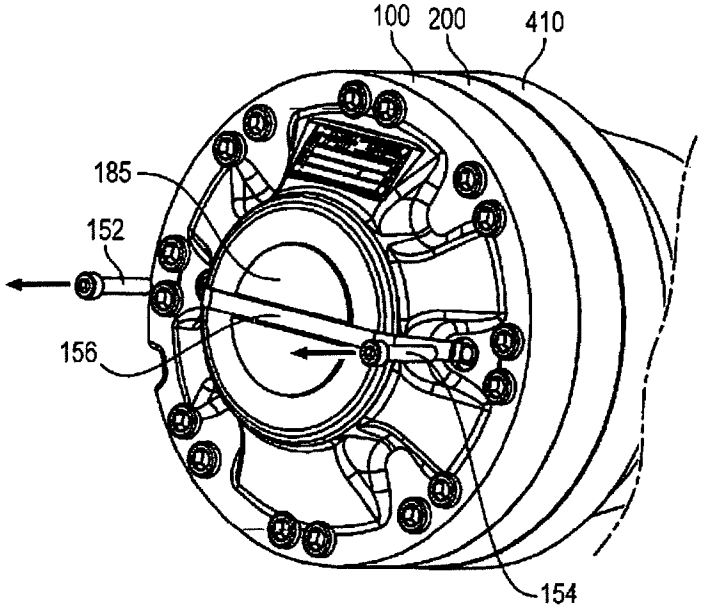

For this purpose, as illustrated in FIGS. 21 and 22, the hydrobase can be equipped with a calliper or strap 156 placed on the external surface of the cover 100, in a diametrical position, and having at its ends eyelets in which the screw shanks 152, 154 are engaged. Once the screws 152, 154 are loosened, it suffices to pull out the strap 156 to then easily extract the screws 152, 154. The cylinder block 300 is then detached from the cover 100 to allow its relative rotation.

The access means to the distributor 600 are therefore also freed. As illustrated in FIGS. 21, 22, these can be a provisional damper 185 freed automatically during withdrawal of the strap 156, if needed.

It can still be the definitive damper 184 assembled by any appropriate means, for example by way of the means illustrated in FIGS. 6 and 7.

Figure 24:
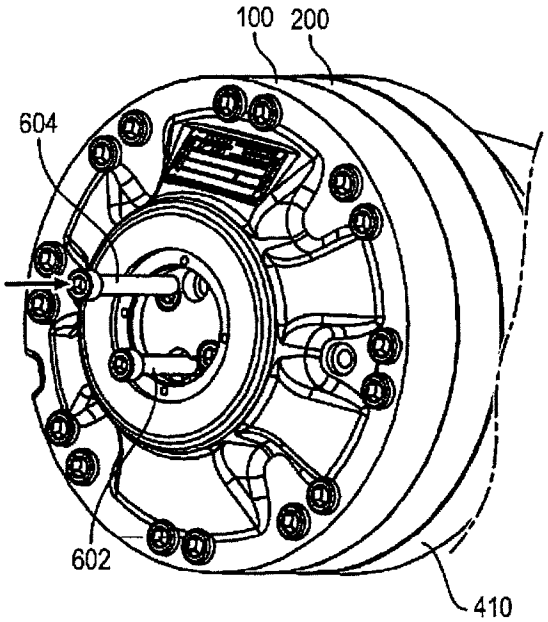
Figure 23:
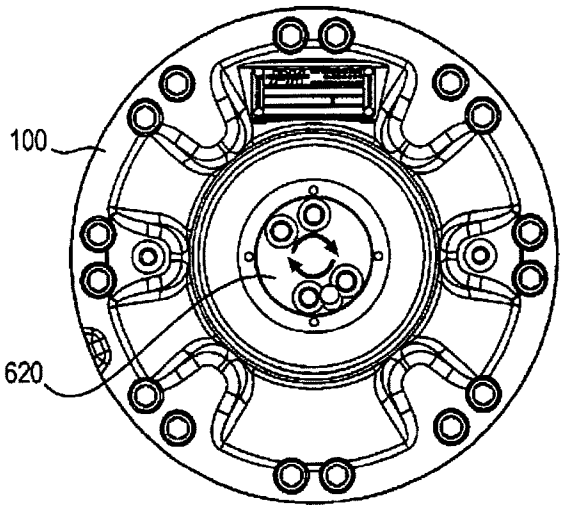

As shown in FIGS. 23 and 24, the installer proceeds with angular orientation of the distributor 600 relative to the shaft 400 so as to align the supply and drain channels of the distributor element relative to the channels made in the shaft 400. Next, the distributor element 600 is fixed on the end axial of the shaft 400 by way of screws 602, 604.

Figure 26:
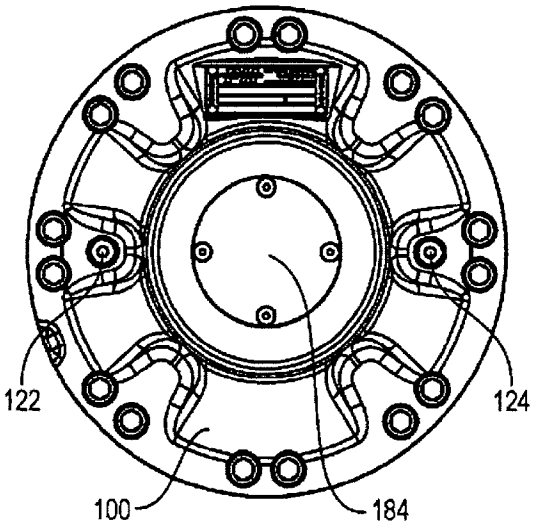
Figure 25:
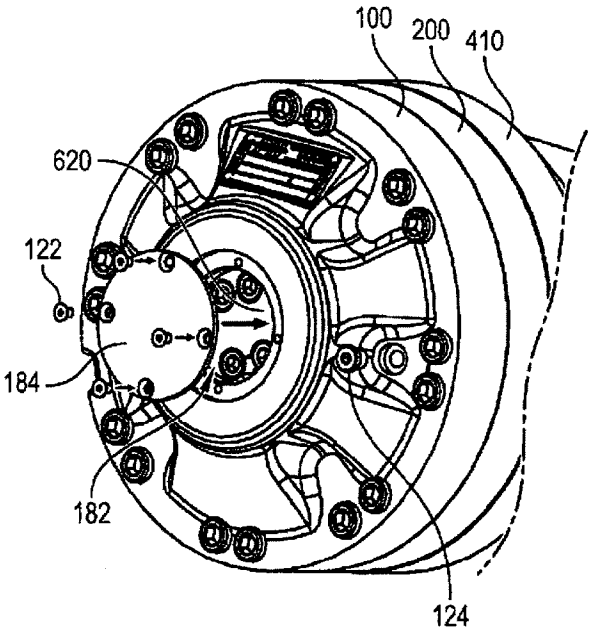

As illustrated in FIGS. 25 and 26, it finally remains to tightly refix the damper 184 and to use sealed plugs to block the orifices previously receiving the fixing means of the cylinder block 300, optionally forming a drain 122, 124.

Of course, the present invention is not limited to the embodiments described earlier and illustrated in the attached figures, but extends to any variant in keeping with its spirit.

By way of example, the fixing means of the distributor element 600, called an ice shield, on the end axial of the shaft, formed from several screws 602, 604 according to FIG. 24, can be replaced by a single bolt to allow a time gain in assembly, as well as a space gain.

The present invention prevents the disassembly/reassembly of components and allows a time gain in assembly by improving the quality and the reliability of the motor on the machine.

The hydrobase according to the present invention forms a cartridge utilisable in particular from testbed to end of development to assembly on the machine of a user.

The hydrobase according to the present invention can be equipped with any appropriate accessory, for example a brake.

The present invention allows rapid assembly of the hydrobase on any machine, as well as any disassembly optionally necessary and this in complete safety. Due to the simplicity of the means proposed it guarantees an operational assembly on completion of assembly. It also enables easy maintenance.

According to a variant embodiment, the hydrobase according to the present invention can be equipped with a hydraulic brake. Since such a brake is known per se, it will not be described in detail herein below.

The invention claimed is:

1. A subassembly comprising:

a cover;

a cam including lobes;

a cylinder block defining cylindrical chambers;

pistons disposed to slide within respective ones of the cylindrical chambers of the cylinder block and being supported on the lobes of the cam;

a distributor configured to apply pressurised fluid on the pistons;

a provisional fastener configured to temporarily fix the cylinder block to the cover, wherein the provisional fastener is a screw, a bolt, or a pin; and wherein the cover includes an opening for allowing access to the distributor through the cover.

2. The subassembly as claimed in claim 1, wherein the cam is fixed to the cover with pins or screws.

3. The subassembly as claimed in claim 1, wherein the distributor includes a central piece and an external piece, the central piece configured to be fixed to an end of a shaft, and the external piece disposed around the central piece and attached to the cover to rotate with the cover.

4. The subassembly as claimed in claim 3, wherein the central piece has peripheral annular grooves on a radially external face of the central piece, and channels having longitudinal portions which communicate with respectively complementary channels formed in the shaft, and transverse portions which terminate at the peripheral annular grooves, and wherein the external piece has channels having transverse portions which terminate adjacent the peripheral annular grooves and longitudinal portions which terminate adjacent supply orifices that are formed in a wall of the cylinder block and connected to the cylindrical chambers.

5. The subassembly as claimed in claim 4, wherein respective surface areas of exposed cross-sections on either side of the channels of the external piece of the distributor differ in each of such channels and among different of such channels to generate force that pushes the external piece axially against an adjacent face of the cylinder block when the distributor is pressurized with a fluid.

6. The subassembly as claimed in claim 4, further comprising springs configured to push the external piece of the distributor against the cylinder block.

7. The subassembly as claimed in claim 1, wherein the opening for allowing access to the distributor through the cover is formed in the center of the cover and passes through the cover, and further comprising a removable damper configured to fit within the opening.

8. The subassembly as claimed in claim 7, wherein the damper is affixed to the cover with a plurality of screws.

9. The subassembly as claimed in claim 7, wherein the damper is affixed to the cover with an elastic ring.

10. The subassembly as claimed in claim 1, further comprising a removable strap having an eyelet configured to accept the provisional fastener.

11. The subassembly as claimed in claim 1, wherein the cover includes a borehole in which the provisional fastener is selectively inserted, and further comprising a plug for insertion into the borehole in the cover after withdrawal of the provisional fastener.

12. The subassembly as claimed in claim 1, further comprising a plate removably affixable on a face of the cam opposite the cover.

13. A process of assembling the subassembly as claimed in claim 1, on a shaft, the process comprising:

withdrawing a blanking plate located on a face of the cam opposite the cover;

fitting the subassembly on an end of the shaft;

removing the provisional fastener;

removing a removable damper configured to fit within the opening;

angularly orienting the distributor relative to the end of the shaft to align channels formed in the shaft with complementary channels formed in the distributor;

fixing a central piece of the distributor relative to the end of the shaft; and closing the opening.

14. The process as claimed in claim 13, further comprising placing support rods on a casing adjacent the shaft to serve as support for the cover of the subassembly during the step of fitting the subassembly on the end of the shaft.

15. The process as claimed in claim 13, further comprising blocking a borehole in the cover in which the provisional fastener is selectively inserted with a plug.

16. The subassembly as claimed in claim 3, wherein the external piece is attached to the cover with a finger or a wedge pin.

17. A subassembly comprising:

a cover;

a cam including lobes;

a cylinder block defining cylindrical chambers;

pistons disposed to slide within respective ones of the cylindrical chambers of the cylinder block and being supported on the lobes of the cam;

a distributor configured to apply pressurised fluid on the pistons;

a provisional fastener configured to temporarily fix the cylinder block to the cover such that, when temporarily fixed, the the cylinder block cannot rotate with respect to or move axially away from the cover; and wherein the cover includes an opening for allowing access to the distributor through the cover.

18. The subassembly as claimed in claim 17, wherein the cam is fixed to the cover with pins or screws.

19. The subassembly as claimed in claim 17, wherein the distributor includes a central piece and an external piece, the central piece configured to be fixed to an end of a shaft, and the external piece disposed around the central piece and attached to the cover to rotate with the cover.

20. The subassembly as claimed in claim 17, wherein the opening for allowing access to the distributor through the cover is formed in the center of the cover and passes through the cover, and further comprising a removable damper configured to fit within the opening.

* * * * *